United States Patent [19]

Tanaka et al.

[11] Patent Number: 4,562,129

[45] Date of Patent: Dec. 31, 1985

[54] METHOD OF FORMING MONOCHROMATIC OR DICHROMATIC COPY IMAGES

[75] Inventors: Susumu Tanaka, Aichi; Kaoru Takebe, Toyokawa, both of Japan

[73] Assignee: Minolta Camera Kabushiki Kaisha, Osaka, Japan

[21] Appl. No.: 534,144

[22] Filed: Sep. 21, 1983

[30] Foreign Application Priority Data

Sep. 28, 1982 [JP] Japan ..... 57-169991
Nov. 25, 1982 [JP] Japan ..... 57-207334

[51] Int. Cl.[4] ..... G03G 13/01
[52] U.S. Cl. ..... 430/42; 430/54; 430/106.6; 430/126
[58] Field of Search ..... 430/42, 45, 46, 54, 430/107, 108, 106.6, 122, 126

[56] References Cited

U.S. PATENT DOCUMENTS 4,284,702 8/1981 Tabuchi et al. ..... 430/106.6
4,335,194 6/1982 Sakai ..... 430/46
4,346,982 8/1982 Nakajima et al. ..... 430/54
4,430,402 2/1984 Tsushima ..... 430/45

FOREIGN PATENT DOCUMENTS 57-8553 1/1982 Japan .

*Primary Examiner*—John L. Goodrow
*Attorney, Agent, or Firm*—Wenderoth, Lind & Ponack

[57] ABSTRACT

The invention relates to a method of forming monochromatic or dichromatic copy images with use of a developer composed of a high-resistivity magnetic carrier and a nonmagnetic insulating toner which are triboelectrically chargeable. An electrostatic latent image having at least three different levels of potentials is formed and the toner and carrier are adhered respectively onto first and second image portions.

9 Claims, 17 Drawing Figures

METHOD OF FORMING MONOCHROMATIC OR DICHROMATIC COPY IMAGES

BACKGROUND OF THE INVENTION

1. Field of the Invention

The present invention relates to an image forming method, and more particularly to a method of forming monochromatic or dichromatic copy images easily with use of a developer composed of a highly resistive magnetic carrier and a nonmagnetic insulating toner which are triboelectrically chargeable.

2. Description of the Prior Art

In recent years, various copying machines have been proposed for making composite copies. With such machines, the usual step of exposure is followed by an exposure with use of a laser or an array of light-emitting diodes to form a composite latent image, which is developed and transferred. These machines are very useful for processing information. As disclosed specifically also in U.S. Pat. No. 4,346,982, the composite latent image thus formed has at least three different potential levels, so that the image area of a potential higher than the intermediate potential must be developed by the normal process, while the image area of lower potential needs to be subjected to reverse development. Accordingly when a two-component developer is used for development, there is the need to conduct normal development and reversal development separately. This requires two developing units, which render the machine large-sized inevitably. Further for the purpose of edition and discrimination, composite copying often involves the necessity of using different colors for developing the image obtained by primary exposure and the image additionally formed by secondary exposure. This gives rise to the need for two developing units, invariably making the copying machine large-sized.

In addition to the proposals for composite copying, various processes are also proposed for forming a dichromatic copy image from a single original image. For example, Published Unexamined Japanese Patent Application No. SHO 55-117155 discloses a process which employs a photosensitive member comprising a first photoconductive layer laminated to a conductive substrate and photosensitive to a first color (e.g. red), an intermediate layer over the layer, and a second photoconductive layer over the intermediate layer and photosensitive to a second color (e.g. black). Latent electrostatic images corresponding to copy images of first color and second color are formed in opposite relation in polarity by specified steps and then developed to visible images with two kinds of toners charged to a polarity opposite to each other and having different colors. Another process for forming dichromatic copy images is also proposed which employs a photosensitive member comprising a photoconductive layer laminated to a conductive substrate and having photosensitivity to both polarities as well as to two colors and in which latent electrostatic images corresponding to copy image areas of first color and second color are formed in opposite relation in polarity by specified steps and then developed with toners of two different colors. However, dichromatic copy image forming processes including these processes have the drawback of generally necessitating two developing units and therefore a copying machine of correspondingly increased size because two kinds of toners of different colors are used for development. Although a dichromatic developing method is proposed which uses a single developing unit, the method fails to give sharp dichromatic copies since fog or mingling of colors is liable to occur in copy images.

SUMMARY OF THE INVENTION

The main object of the present invention is to provide a method of forming monochromatic or dichromatic copy images with ease.

Another object of the invention is to provide an image forming method adapted to produce satisfactory monochromatic or dichromatic copies with use of a simple arrangement under conditions which are settable very easily.

Another object of the invention is to provide an image forming method by which a composite latent electrostatic image formed by two exposures can be satisfactorily developed by a single developing unit to give a distinct copy image free of fog.

Still another object of the invention is to provide an image forming method in which a latent electrostatic image formed from a dichromatic original can be satisfactorily developed in two colors by a single developing unit to give a distinct copy free of fog.

These and other objects of the present invention can be fulfilled by an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to about 40 microns in size, prepared by dispersing a magnetic fine powder in an insulating resin and containing the magnetic fine powder in a proportion of 50 to 75% by weight.

DETAILED DESCRIPTION OF THE INVENTION

Figure 1:
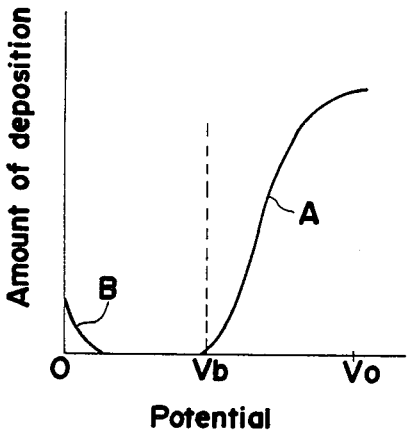
FIGS. 1 and 2 are diagrams showing the amounts of deposition of a nonmagnetic toner and a high-resistivity magnetic carrier when varying bias voltages applied to a development electrode.

The first feature of the image forming method of the present invention is the use of a developer which comprises at least two components of a nonmagnetic insulating toner and a high-resistivity magnetic carrier triboelectrically chargeable with the toner and having a high resistivity of at least $10^{12}$ ohm-cm, the carrier being in the form of particles about 5 to about 40 microns in size, prepared by dispersing a magnetic fine powder in an insulating resin and containing the magnetic fine powder in a proportion of 50 to 75% by weight.

This developer is disclosed in U.S. Pat. No. 4,284,702 which has been assigned to the same assignee as the present invention. It is much superior to conventional ones especially in resolving power and latitude. The high-resistivity magnetic carrier of the developer is prepared, for example, by mixing together an insulating resin and a magnetic fine powder in a molten state, pulverizing the mixture after cooling and separating off a fraction which is about 5 to about 40 microns in particle size. Examples of useful insulating resins are polyethylene, polyacrylic ester, polymethyl methacrylate, polystyrene, styrene-acrylic copolymer, epoxy resin, cumarone resin, maleic acid resin, phenolic acid resin, etc. Examples of suitable magnetic fine powders are $Fe_2O_3$, $Fe_3O_4$, ferrite and like powders. On the other hand, the non-magnetic insulating toner can be those already known and having a mean particle size of about 5 to about 50 microns and a volume resistivity of at least about $10^{14}$ ohm-cm.

The high-resistivity carrier and the nonmagnetic insulating toner are agitated and thereby triboelectrically charged to a polarity opposite to each other to form a magnetic brush, whereby the toner is deposited on a photosensitive member in accordance with a pattern of latent image to develop the image.

We practiced the magnetic brush development process with use of the above developer under varying conditions to find the following. This process is carried out by applying bias voltage to a development electrode. The bias voltage serves to prevent the deposition of the toner on the nonimage areas of latent electrostatic image when set to a somewhat higher level than the potential of the nonimage areas. When the magnetic brush development process was thus practiced, first we found that there is no deposition of the nonmagnetic insulating toner at potentials almost equal or approximate to the bias voltage, especially at potentials below the bias voltage. Second, we found that there is no deposition of the high-resistivity magnetic carrier at potentials within a certain range in reverse relation to the latent image potential permitting the deposition of the toner with respect to the bias voltage, whereas the deposition of the carrier takes place at potentials beyond the above-mentioned range.

This will be described with reference to FIG. 1, in which the amount of deposition of the toner or carrier (image density) is plotted as ordinate vs. the potential plotted as abscissa, and indicated at V0 is the surface potential or image area high potential on the photosensitive member, and at Vb the bias voltage applied to the development electrode and slightly higher than the nonimage area potential. Curves A and B represent the amounts of deposition of the nonmagnetic insulating toner and the high-resistivity magnetic carrier, respectively, at varying potentials. It is now assumed that a latent electrostatic image is formed on the photosensitive member by the usual Carlson process. The diagram reveals little or no toner deposited on the portion of potentials approximate to the bias voltage Vb, especially no deposition on the portion of potentials below Vb. The toner is deposited on the potential portion higher than Vb as indicated by Curve A. On the other hand, the deposition of the carrier, although slight as indicated by Curve B, occurs on a potential portion approximate to 0 V and much lower than Vb. In the above case, this deposition is due to reversal development.

Based on the foregoing fact, we have found that when a latent electrostatic image is so formed that the bias voltage Vb applied to the development electrode has a given relation with a potential portion higher than the bias voltage as well as with a potential portion lower than the bias voltage, the nonmagnetic insulating toner can be deposited on the latent image potential portion higher than the bias voltage Vb, while high-resistance magnetic carrier can be positively deposited on the latent image potential portion sufficiently lower than Vb. The principle of development involved in the image forming method of the invention is shown in FIG. 2, in which V1 is a first image area potential, V2 is a second image area potential, V3 is a nonimage area potential, Vb is a development bias voltage slightly higher than V3, Vc is the combined threshold potential of magnetic field and electric field, Curve C shows the amount of deposition of the nonmagnetic insulating toner, and Curve D shows the amount of deposition of the high resistivity magnetic carrier. As will become apparent from the description to follow, V1, V2 and V3 may be of the same polarity, or at least V1 and V2 may be in opposite relation in polarity. Accordingly when V1, V2 and V3 are of the same polarity, V1 is higher than V0 in FIG. 1, and Vb is also higher than that in FIG. 1 when the amounts of exposure are the same.

Figure 2:
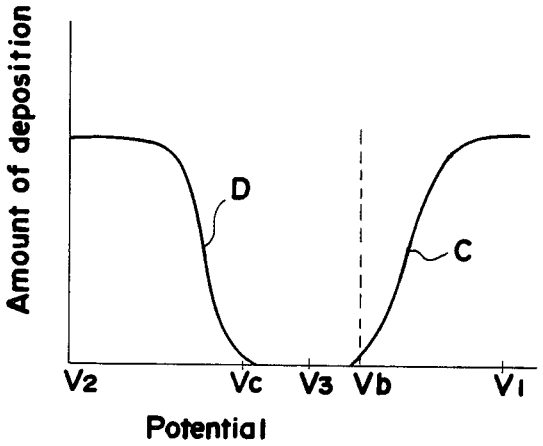

Further as is the case with FIG. 1, neither the carrier nor the toner is deposited on the potential portion approximate to the bias voltage Vb. Especially no deposition of the toner occurs at the potentials below Vb. In contrast, the toner is deposited at potentials above Vb (or more precisely, at potentials tens of volts higher than Vb) and up to the first image area potential V1 as indicated by Curve C. This deposition of toner is caused by normal development, and the toner is triboelectrified to a polarity opposite to that of V1. On the other hand, none of the carrier having a polarity opposite to that of the toner is deposited at the potentials from the bias voltage Vb to the threshold voltage Vc, but the carrier is deposited at the potentials from Vc to the second image area potential V2 as indicated by Curve D. This deposition is due to reversal development. While the threshold voltage Vc is dependent on the magnetic force of the carrier, the magnetic force of the magnetic brush developing unit used, the surface potential of the photosensitive member, etc, the electrostatic force afforded by the latent image potential overcomes the magnetic forces to transfer the carrier onto the photosensitive member. As will become apparent from the experimental example to be given later, the deposition of the carrier occurs when the difference between the potential and the bias voltage is about 200 V in absolute value. The same is true of the case wherein V1 and V2 are opposite to each other in polarity; the toner is deposited at potentials between the bias voltage Vb and V1, and the carrier at potentials between Vc and V2, each by normal development.

Thus according to the invention, the nonmagnetic insulating toner and the high-resistivity magnetic carrier are deposited on the first image area and the second image area, respectively, which are potentially opposite relation with respect to the bias voltage Vb. Nevertheless, composite images and dichromatic images can be developed easily with use of a single developing unit. Further because the carrier is nearly as fine as the toner, i.e., 5 to 40 microns in particle size, and exhibits a high resolving power when used for forming visible images and also because the carrier can be fixed satisfactorily, monochromatic or dichromatic copy images can be formed with ease.

The image forming method will be described first for producing composite images.

Figure 3:
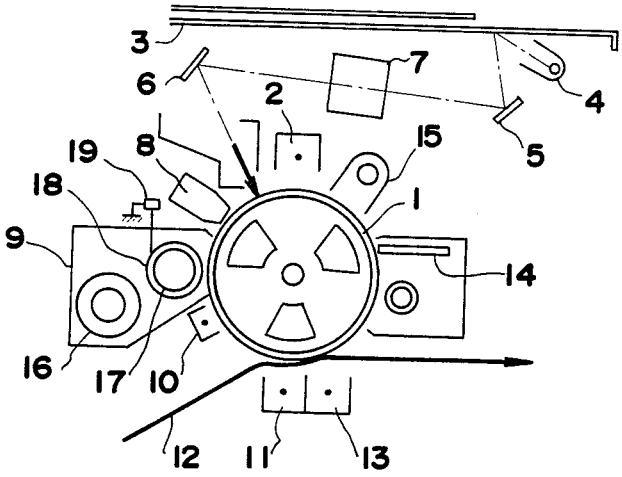
FIG. 3 is a schematic sectional view showing the construction of a copying machine for giving monochromatic or dichromatic composite images according to the image forming method embodying the invention.

FIG. 3 schematically shows the construction of a copying machine for producing composite images by the image forming method of the invention. A photosensitive drum 1 rotatable counterclockwise is first uniformly charged by a main corona charger 2. Subsequently an original placed on a carriage 3 is exposed to light by an exposure lamp 4, and the drum 1 is continuously exposed to the image of the original via mirrors 5, 6 and a lens 7, whereby a first latent electrostatic image is formed. Negative latent image forming means 8, such as a light-emitting diode array, liquid crystal array, OFT or laser scanner, is adapted to form a second latent electrostatic image. Indicated at 9 is a magnetic brush developing unit for developing the first and second latent images, at 10 a precharging corona charger, at 11 a transfer corona charger for transferring developed images to copy paper 12, at 13 a separating corona charger for separating the copy paper from the drum surface after the image transfer, at 14 a blade cleaner for removing remaining developer, and at 15 an eraser lamp for removing residual charges.

The magnetic brush developing unit 9 is adapted for use with the above-mentioned high-resistivity magnetic carrier and the nonmagnetic insulating toner as a developer. The carrier and the toner are thoroughly agitated by an agitating roller 16 and thereby triboelectrically charged to a polarity opposite to each other. The toner is charged to a polarity opposite to that of the first and second latent images, while the carrier is charged to the same polarity as the images. A magnet roller 17 and sleeve roller 18 are rotatable in the same direction at different speeds to form a magnetic brush on the sleeve roller and thereby develop the latent electrostatic images. Predetermined bias voltage Vb is applied to the sleeve roller 18 by a d.c. voltage source 19. U.S. Pat. No. 4,338,880 discloses a magnetic brush developing unit of such construction, which is to be included in the present invention.

Figure 4A:
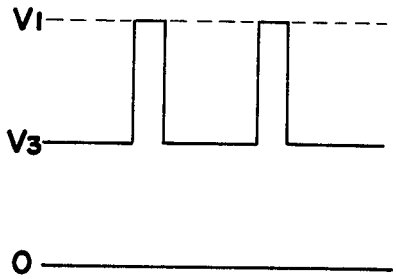
FIGS. 4*a*, 4*b* and 4*c* are diagrams showing potential pattern of a composite latent electrostatic images formed by the copying machine of FIG. 3.

A composite image is formed by the copying machine of the structure described above in the following manner. The photosensitive member 1 is first charged by the main corona charger 2 to an initial surface potential V1, for example, of negative polarity. Subsequently the original on the carriage 3 is continuously exposed to light to form a positive first latent electrostatic image. FIG. 4*a* shows the resulting potential pattern, in which the nonimage area potential is attenuated to V3. Thus the photosensitive member is exposed to the original image with such light intensitity that the nonimage area potential V3 will be about one half the initial surface potential, namely, the first image area potential V1.

Figure 4B:
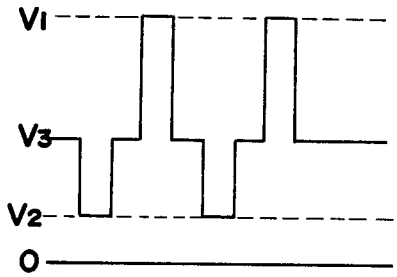

Next, a negative second latent electrostatic image is formed on the drum 1 by the negative latent image forming means 8, such as a light-emitting diode array or laser, which projects the required information on the drum 1. As shown in FIG. 4*b*, the negative image area has an attenuated potential of V2. Consequently the photosensitive member 1 thus exposed twice has formed thereon a composite latent electrostatic image including the positive image area of potential V1, positive and negative nonimage areas of potential V3 and negative image area of potential V2 as mentioned in the order of decreasing potential.

Figure 4C:
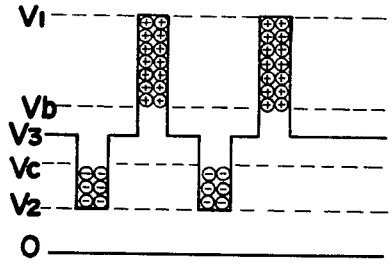

The composite latent image thus formed is then developed by the magnetic brush developing unit 9. The nonmagnetic insulating toner to be used is triboelectrically chargeable to positive polarity opposite to the polarity of the latent image, and the high-resistivity magnetic carrier to be used is similarly chargeable to the same negative polarity as the image. While the toner and carrier may be of the same color, the first and second latent images will be developed in different colors and convenient to discriminate if they have different colors, e.g., black and red. The bias voltage Vb to be applied to the sleeve roller 18 by the d.c. voltage source 19 is predetermined at a slightly higher level than the nonimage area potential V3 as shown in FIG. 4*c*. With magnetic bristles fibers formed on the sleeve roller 18 and with the bias voltage Vb applied to the roller 18, the toner is deposited on the portion of potential V1 which is higher than Vb and the carrier on the potential portions not higher than Vc.

This will be described in greater detail. As already stated with reference to FIG. 2, the toner is deposited by normal development on the portion of potentials above the bias voltage Vb. In FIG. 4*c*, the toner is deposited on the potential portion between V1 and Vb and corresponding to the positive image area. More precisely the toner is deposited at potentials at least several tens of volts higher than Vb. On the other hand, neither the toner nor the carrier is deposited on the potential portion lower than the bias voltage Vb but not lower than a certain value as already described. This portion corresponds to the potential portion between Vb and Vc in FIG. 4*c* and substantially to the nonimage areas. The carrier is deposited at potentials below Vc, i.e., on the negative image area of potential V2. It is noted that the carrier itself is of the same polarity as the latent image and the bias voltage Vb applied to the sleeve roller 18 is also of the same polarity as the carrier, so that the carrier, which is subjected to a repellent force, overcomes the magnetic force of the magnet roller 17 and becomes deposited on the drum 1 over the latent image low-potential portion V2 below the threshold voltage Vc. In other words, the carrier is deposited by reversal development.

When the toner and the carrier are different in color, the two component images can be identified with ease and nevertheless can be developed with use of a single developing unit.

The nonmagnetic insulating toner is deposited on a potential portion slightly higher than the bias voltage Vb, while the high-resistivity magnetic carrier is deposited on a potential portion at least about 200 V lower than the bias voltage Vb, although this is considerably dependent on the developing conditions, properties of the toner and the carrier, etc., as will be described with reference to the experimental example to be given later. Stated with reference to FIG. 4, the carrier is deposited on the potential portions below Vc. In connection with this, the potential V2 corresponding to the image area formed by the second exposure must be below the potential V3 of the nonimage areas and at least 200 V lower than Vb. Since the carrier can be deposited even on a zero-volt potential portion, V2 can be 0 V.

The composite latent electrostatic image on the drum 1 is developed in a single color or two colors in this way and then charged to positive polarity by the precharging charger 10, whereby the carrier is made to have the same polarity as the toner. However, when the toner image is to be transferred by pressure or heat, the precharing corona charger can be dispensed with. Subsequently negative corona ions are applied to the rear side of copy paper by the transfer corona charger 12 to transfer the developed image onto the paper 11. The paper 11 is thereafter separated from the drum 1 by the separating corona charger 13 and fed to an unillustrated fixing unit to fix the image, whereby a finished copy is obtained. On the other hand, the developer remaining on the drum 1 is removed by the blade cleaner 14, the residual charges are then removed from the drum by the eraser lamp 15, and the drum 1 is thus made ready for the next copying cycle.

Figure 5:
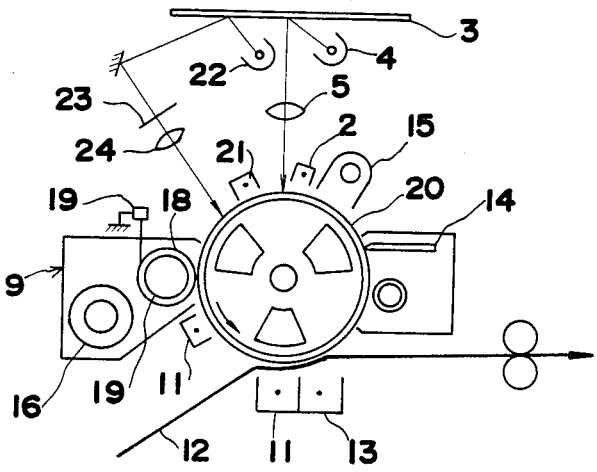
FIG. 5 is a schematic sectional view showing the construction of a copying machine for producing dichromatic copy images from dichromatic originals according to the image forming method embodying the invention.

FIG. 5 shows the construction of a copying machine for producing dichromatic images by the image forming method of the invention. The same parts as those shown in FIG. 3 individually in corresponding relation will be referred to each by the same corresponding numerals and will not be described.

FIG. 5 shows a photosensitive drum 20 rotatable counterclockwise and sensitive to both positive and negative polarities. First, the drum 20 is uniformly charged to a first polarity by a first corona charger 2. Subsequently, a two-color original placed on a carriage 3 reciprocatingly movable is exposed to light by an exposure lamp 4 to continuously expose the drum 20 to the image of the original through a lens 5 to form a primary latent electrostatic image, which is then charged by a second corona charger 21 of second polarity. The same original is thereafter exposed to light by an exposure lamp 22, and the image of the original is projected on the drum through a cutoff filter 23 and a lens 24 to form a secondary latent electrostatic image. Indicated at 9 is a magnetic brush developing unit of the same construction as the one already described for developing latent images.

Dichromatic copy images will be formed by the method of the invention in the following manner with use of the copying machine of above construction. The drum 20 in rotation is first uniformly charged by the first corona charger 2 to a surface potential Vo of positive polarity as shown in FIG. *6a*. Next, the drum 20 is exposed to the optical image of the two-color original to form a primary latent electrostatic image thereon as seen in FIG. *6b*. When the original used includes a red image and a black image, the exposure attenuates the potential Vo to Vr at the portion corresponding to the red image area and to Vg approximate to 0 at the nonimage area (blank area), but remains almost Vo at the black image area. The primary latent image having the potential pattern of Vo, Vr and Vg is charged by the second corona charger 21 to negative polarity to form the pattern of FIG. *6c*. Thus the lowest nonimage area potential Vg is inverted to Vg' of negative polarity and the red image area potential Vr also to V1 of negative polarity by the charging, with the black image area potential Vo lowered to V2 and retaining the positive polarity. In this state, the drum 20 is exposed again to the optical image of the same original, through the red cutoff filter 23 at this time to thereby form a secondary latent electrostatic image of the potential pattern shown in FIG. *6d*. This exposure attenuates the nonimage area potential Vg' to V3 approximate to 0, while permitting the red and black image area potentials V1 and V2 to remain unchanged.

The secondary latent image thus formed is subsequently developed by the magnetic brush developing unit 9. The toner to be used is, for example, one colored red and triboelectrically charged to a polarity (positive) opposite to that of the red image area potential v1, and as the carrier is used one colored black and charged to a polarity (negative) opposite to that of the toner and also to that of the black image area potential V2. On the other hand, the bias voltage Vb applied to the sleeve roller 18 by a d.c. voltage source 19 is set at a slightly higher level than the nonimage area potential V3 as shown in FIG. *6e*. By magnetic brush bristles formed on the sleeve roller 18 and the bias voltage Vb applied, the toner is deposited on the potential portion between Vb and the red image area potential V1, and the carrier on the potential portion between Vc and the black image area potential V2.

This will be described in greater detail. As already stated with reference to FIG. 2, no deposition of the toner occurs at potentials close to the bias voltage Vb, especially below Vb, whereas the red toner is deposited on the potential portion above Vb, i.e., the red image area potential portion between Vb and V1. Stated more precisely, the toner starts deposition at a potential several tens of volts higher than Vb. On the other hand, the carrier is not deposited on the potential portion up to the predetermined value Vc, on one side of the bias voltage Vb opposite to the toner depositable potential portion, as stated above. The former potential portion corresponds to the portion between Vb and Vc in FIG. *6e*. Thus the black carrier is deposited on the potential portion above the threshold potential Vc, i.e., the portion between Vc and the black image area potential V2. In this way, dichromatic development is realized accurately in conformity with the red-and-black original. Although the toner and the carrier described above are red and black and triboelectrically chargeable positively and negatively respectively, they can be in reverse relation in color and polarity. In this case, the bias voltage is set as a voltage of positive polarity lower than V3 instead of being a slightly higher voltage of negative polarity. Further because the deposition of the carrier does not occur over a potential range, i.e., over the range of about 200 V, from Vb as already stated, the potential at which the carrier is to be deposited must be different from Vb by much more than 200 V in absolute value. The toner and the carrier may be of the same color when there is no need to produce dichromatic copies.

The image thus developed in two colors on the drum 20 is then charged to positive or negative polarity by a precharging corona charger 10 and thereafter transferred to copy paper in the same manner as in the machine of FIG. 3. The drum is cleaned and erased in preparation for the next copying cycle.

Figure 7:
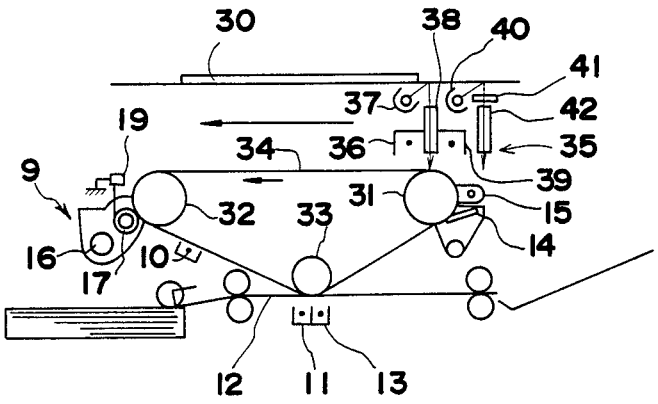
FIG. 7 is a schematic sectional view showing the construction of a copying machine for producing dichromatic copy images according to the image forming method embodying the invention.

FIG. 7 shows another transfer-type copying machine embodying the invention for forming dichromatic copy images. Throughout FIGS. 5 and 7, like parts are referred to by like reference numerals without giving a description of such parts of FIG. 7. The drawing shows a fixed carriage 30 for supporting a two-color original thereon. A photosensitive belt 34 disposed below the carriage 30 is rotatably supported by rollers 31, 32 and 33 including a drive roller. A unit of optical system 35 reciprocatingly movable in its entirety is provided between the belt 34 and the carriage 30. The unit 35 comprises a first corona charger 36 for uniformly charging the surface of the belt 34 to a first polarity, a first image transmitter 38 in the form of a bundle of optical fibers, such as Selfoc (registered trademark), for continuously projecting the image of the original exposed to the light of a first exposure lamp 37, a second corona charger 39 for charging the belt surface to a second polarity, and a second image transmitter 42, such as the one mentioned above, for projecting through a cutoff filter 41 the image of the original illuminated by a second exposure lamp 40.

Figure 6A:
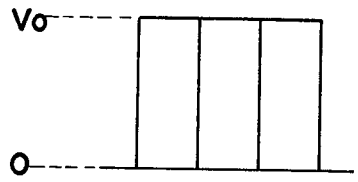
FIGS. 6*a* to 6*e* are diagrams showing the steps of forming a dichromatic copy image by the copying machine of FIG. 5.
Figure 6B:
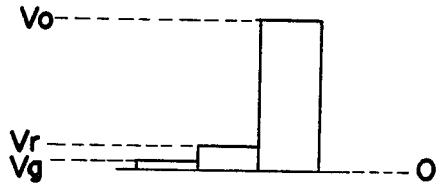
Figure 6C:
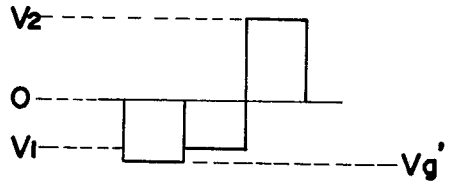
Figure 6D:
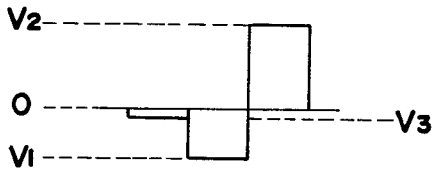

For a copying operation, the optical unit 35 is moved forward in the direction of arrow shown, with the belt 34 at rest, whereby the belt surface is first uniformly charged by the first corona charger 36, for example, to positive polarity as shown in FIG. 6*a*. This uniform charging is followed by continuous exposure of the belt surface to the image of the two-color original by means of the first exposure lamp 37 and the first image transmitter 38, whereby a primary latent electrostatic image is formed as shown in FIG. 6*b*. While being continuously formed, the primary latent image is charged by the second corona charger 39 of negative polarity to form a potential pattern as shown in FIG. 6*c*. The image of the same original is further projected on the belt surface by means of the second exposure lamp 40, the cutoff filter 41 and the second image transmitter 42. Thus a secondary latent electrostatic image as shown in FIG. 6*d* is eventually formed on the planar portion of the belt 34 opposed to the carriage 30.

Figure 6E:
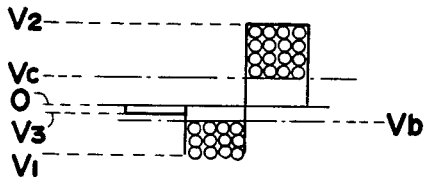

Upon the formation of the secondary latent image, the photosensitive belt 34 starts to travel, causing magnetic brush developing unit 9 to develop the image in two colors as shown in FIG. 6*e* with the application of bias voltage Vb. The developed image is then charged by a precharging corona charger 10, thereafter transferred to copy paper 12 and fixed by heat rollers.

Figure 8:
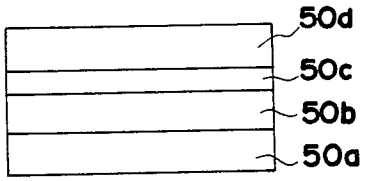
FIG. 8 is a diagram showing an example of photosensitive member which is usable for the image forming method of the invention.

With the copying machines described above and shown in FIGS. 5 and 7, the photosensitive members used have photosensitivity to both polarities and form the latent image to be eventually developed by being exposed to the original image twice, while the photosensitive member disclosed in Published Unexamined Japanese Patent Application No. SHO 55-117155 is adapted to form a dichromatic copy image by a single exposure to the original image without necessitating any cutoff filter. This photosensitive member is shown in FIG. 8 and comprises a first photoconductive layer 50*b*, an intermediate layer 50*c* and a second photoconductive layer 50*d* which are laminated in succession to a conductive substrate 50*a*. The first conductive layer 50*b* is chargeable to a first polarity and has sensitivity, example, to light rays other than red, while the second conductive layer 50*d* is chargeable to a second polarity and has sensitivity to red light.

Figure 9:
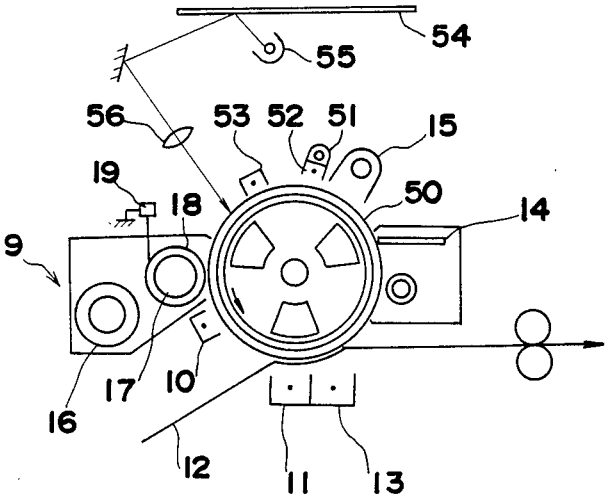
FIG. 9 is a schematic sectional view showing the construction of a copying machine including the photosensitive member of FIG. 8.

FIG. 9 schematically shows the construction of a copying machine wherein the above-mentioned photosensitive member 50 is used for producing two-color copy images. The member 50 is first irradiated with red light and subjected to primary charging of positive polarity by a unit comprising a lamp 51 and a first corona charger 52, whereby the second photoconductive layer 50*d* is made conductive, a distribution of positive charges is induced at the interface between the second layer 50*d* and the intermediate layer 50*c*, and a distribution of negative charges is induced at the interface between the substrate 50*a* and the first photoconductive layer 50*b*. The member 50 is then subjected by a second corona charger 53 to secondary charging of negative polarity to a potential lower than the primary charging to invert the surface potential of the second photoconductive layer 50*d* to negative polarity, whereby an electric double layer is formed in the first and second photoconductive layers 50*b* and 50*d*. Subsequently a two-color original on a reciprocatingly movable carriage 54 is illuminated by an exposure lamp 55 to continuously project the original image on the member 50 through a lens 56. The exposure attenuates the potential of the photosensitive portion to 0 at the blank portion, while at the red portion, the second photoconductive layer 50*d* only is made conductive with disappearance of the electric double layer, and the surface potential is inverted to positive polarity. Meanwhile, the potential of the black portion retains negative polarity. The latent electrostatic image thus formed is next developed in two colors by a magnetic brush developing unit 9 in the same manner as already described in detail. In this procedure, the bias voltage Vb is set with the same polarity as the area where the nonmagnetic insulating toner is to be deposited. With the exception of the above feature, the machine of FIG. 9 has the same construction as the one shown in FIG. 7, so that throughout these drawings, like parts are referred to by like reference numerals instead of giving the description concerned. The process for forming a latent electrostatic image corresponding to the two-color original, as well as the photosensitive member, is not limited to the foregoing; the processes disclosed, for example, in Published Unexamined Japanese Patent Application No. SHO 54-112634 and U.S. Pat. No. 4,335,194 etc. are usable. In brief, any process is useful insofar as the latent image can be so formed that the potentials corresponding to the first color and the second color are in opposite relation in polarity.

An experimental example will be described below.

EXPERIMENTAL EXAMPLE 1

The relation was determined between the bias voltage Vb and the reflection density of a nonmagnetic insulating toner deposited at potentials V1 higher than Vb, as well as between Vb and the reflection density of a high-resistivity magnetic carrier deposited at potentials lower than Vb. An apparatus of the construction shown in FIG. 3 was used for the experiment without operating the negative latent image forming means 8. The photosensitive drum 1 was prepared by dispersing a photoconductive fine powder of $CdS.nCdCO_3$ in thermosetting acrylic resin with a solvent, applying the dispersion to the surface of an aluminum drum 80 mm in diameter to form a 30-micron-thick photoconductive layer over the drum surface, and laminating an insulating protective layer of acrylic resin, up to 0.5 micron in thickness, to the layer.

For the nonmagnetic insulating toner, the one manufactured with the following compositions was used:

| | |
|---|---|
| Styrene-acrylic copolymer (HYMER-SBM-73 of Sansei Kasei Co., Ltd.) | 100 parts by weight |
| Red colored charge controlling pigment (LAKED RED-C of Dainichiseika Color & Chemicals Mfg. Co., Ltd.) | 5 parts by weight |

For the high-resistivity magnetic carrier, the one with the following composition was used:

| | |
|---|---|
| Styrene-acrylic copolymer (HYMER-SBM-73 of Sansei Kasei Co., Ltd.) | 100 parts by weight |
| Magnetic fine powder (MAGNETITE RB-BL of Chitan Industry Co., Ltd.) | 200 parts by weight |
| Carbon black (KETCHEN BLACK EC of Lion Fat & Oil Co., Ltd.) | 4 parts by weight |
| Fluidity agent (silica) (AEROSIL-200 of Nippon Aerosil Co., Ltd.) | 1.5 parts by weight |

The toner was at least $10^{15}$ ohm-cm in resistivity and 14 microns in mean particle size, had a red color and was triboelectrically chargeable to positive polarity. The carrier was black, $10^{14}$ ohm-cm in resistivity, 20 microns in mean particle size and triboelectrically chargeable to negative polarity, and contained about 65% by weight of the magnetic fine powder (magnetite) based on the resin. The toner and the carrier were mixed together in a ratio of 1:9 to prepare a developer. The amount of charge was 11.6 μc/gr.

The drum 1 was rotated at a speed of 110 mm/sec, and the magnet roller 17 and the sleeve roller 18 were driven at 1300 r.p.m. and 30 r.p.m., respectively. The bias voltage Vb applied to the sleeve roller 18 by the d.c. voltage source 19 was −600 V. The main corona charger 2 was set to give a charge potential of −800 V.

Figure 10A:
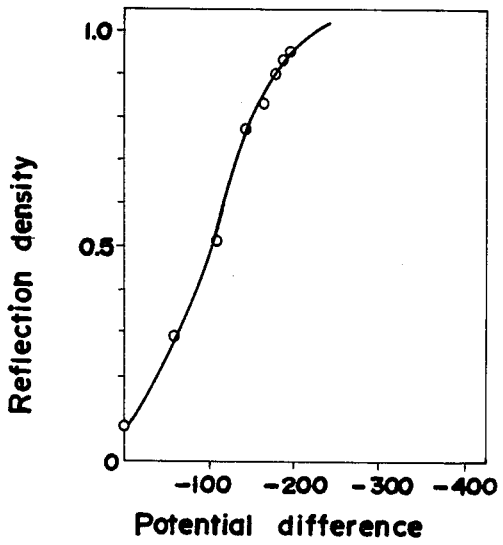
FIGS. 10*a* and 10*b* are diagrams showing the relation between development bias voltage and the reflection densities due to the deposition of a nonmagnetic insulating toner and a high-resistivity magnetic carrier as determined when the image area potential of latent electrostatic image is varied.
Figure 10B:
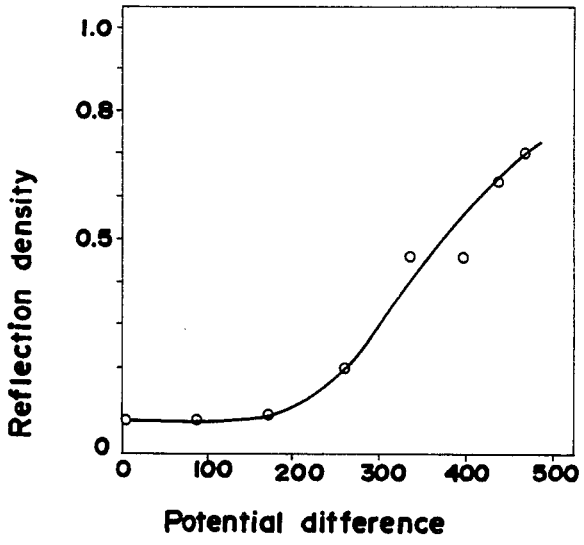

Under the above conditions, the drum 1 was exposed to a 20-step gray scale (product of Kodak Co,) serving as an original, and the latent image was developed to measure the Macbeth reflection density due to the deposition of the toner on the potential portion V1 higher than the bias voltage Vb and the Macbeth reflection density due to the deposition of the carrier on the potential portion V2 lower than the bias voltage Vb. FIGS. 10*a* and 10*b* show the results respectively. With reference to FIG. 10*a*, the toner is deposited for development at a potential which is higher than the bias voltage Vb if slightest, and the density increases with the rise of potential. For example, when V1–Vb is −60 V (i.e., when the image area potential is −660 V), the reflection density is 0.3. The density is 0.5 for the potential difference of −120 V, 0.76 for −150 V, and 0.95 for −200 V. As already stated with reference to FIG. 4*c*, this indicates that the toner is deposited on the image area potential portion V1, above Vb, of the first latent image.

With reference to FIG. 10*b*, the carrier is deposited at the potential V2 which is lower than the bias voltage Vb by at least about 250 V. For example, if V2−Vb is 0, 80 or 170 V, the reflection density is equal to 0, with deposition of no carrier. This substantiates that the carrier is not deposited over a range of potentials below the bias voltage Vb and above the threshold voltage Vc, and that no deposition occurs at potentials below Vb and above Vc in FIG. 4*c*. However, when V2−Vb is 260 V, the carrier starts deposition. The reflection density is 0.45 for the potential difference of 340 to 400 V, 0.64 for 440 V and 0.7 for 470 V. This indicates that the carrier is deposited on the low-potential image area. In FIGS. 10*a* and 10*b*, the rise or inclination of each curve is controllable to some extent in accordance with the developing conditions and the property values of the toner and carrier. In particular, the carrier can be deposited to a sufficient density if the potential is lower than the bias voltage Vb by at least 200 V.

EXPERIMENTAL EXAMPLE 2

Composite images were produced by following the image forming method shown in FIGS. 4*a* to 4*c* and by using the copying machine of FIG. 3. Using the same photosensitive drum 1 and the developer described in Example 1, the drum 1 rotating in the counterclockwise direction was first charged by the main corona charger 2 to the surface potential V1 of −800 V. An original placed on the carriage 3 was then exposed successively to form the first latent image. Here the amount of exposure was adjusted for the surface potential of the exposed portions to decay to about −500 V (V3). Next, the negative latent image forming means 8 of a laser scanner was used to exposed a second information on the previously exposed portions of V3. By the exposure of a negative image, the potential V3 of exposed portions (i.e., image portions) decayed to the potential V2 of about −100 V. The thus formed composite latent image was than developed by the magnetic brush developing unit 9 using the developer mixture of the aforedescribed nonmagnetic insulating toner and high-resistivity magnetic carrier. The bias voltage Vb of −600 V from the d.c. voltage source 19 was applied to the sleeve roller 18 during the development and as the result, the toner of positive polarity and colored in red adhered over the potential portions of −600 V by the normal development whereas the carrier of negative polarity and colored in black adhered on the potential portions between Vc and V2.

The composite image developed accordingly is then positively charged by the precharging corona charger 10 to reverse the polarity of carrier. Thereafter, the developed image is transferred to a transfer paper by the transfer corona charger 11 and subsequently separated from the photosensitive drum 1 which is then heat fixed. Examining the final copy obtained, a clear dichromtic image of high density was obtained. Particularly, no mingling of toner and carrier was observed and also no adhesion of toner and carrier on the background area was seen.

EXPERIMETAL EXAMPLE 3

Dichromatic copy images were produced by following the image forming method shown in FIGS. 6*a* to 6*e* and by using the copy machine of FIG. 5. As the photosensitive drum 20, the one described in Example 1 was used as it has sensitivity to both polarities. Similarly, the same developer described in Example 1 was used.

The photosensitive drum 20 rotating in the counterclockwise direction was first charged by the main corona charger 2 to the surface potential V0 of 800 V and then exposed to a two-color original placed on the carriage 3. By this, the potential of background area decays to Vg of about 50 V and that of red area to Vr of about 100 V. The black area remains substantially unchanged. Next, the photosensitive drum 20 is charged negatively by the second corona charger 21. By this opposite polarity charging, the potential of background area is inverted to Vg' of −300 V, the red area to V1 of −250 V and the black area to V2 of 450 V. Followed by the charging with the second corona charger 21, the photosensitive drum 20 is again exposed to the same original but this time through the red cutoff filter 23. As the result, only the potential of background area decayed to V3 of about −30 V from Vg'. The thus formed electrostatic latent image was developed by the magnetic brush developing unit 9 using the afore-described developer. The bias voltage of −50 V was applied to the sleeve roller 18. The black carrier of negative polarity is deposited over the potential of Vc and the red toner of positive polarity is deposited between Vb and V1. This developed image was then transferred to a transfer paper 12. The copy obtained has a clear dichromatic image of high density.

Numerous modifications and variations of the present invention are possible in light of the above teachings and, therefore, within the scope of the appended claims, the invention may be practiced otherwise than particularly described.

What is claimed is:

1. An image forming method which comprises a first step of forming an electrostatic latent image having at least three levels of different potentials; a second step of developing said electrostatic latent image with a developer while applying to a developing electrode a voltage substantially equal to or close to an intermediate potential, said developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to 40 microns in size composed of a magnetic fine powder dispersed in an insulating resin and containing the magnetic fine powder in a proportion of about 50 to 75% by weight, said toner and carrier adhering onto different image portions of said electrostatic latent image; and a third step of transferring the developed image onto a transfer paper.

2. An image forming method which comprises:

a first step of forming an electrostatic latent image having at least three different levels of potentials with a first level representing a first image portion, a second level representing a second image portion and an intermediate level between the first and second levels representing a background portion for the first and second image portions;

a second step of developing said electrostatic latent image with a developer by a magnetic brush development while applying to a developing electrode a bias voltage substantially equal to or close to said intermediate level of potential, said developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to 40 microns in size composed of a magnetic fine powder dispersed in an insulating resin and containing the magnetic fine powder in a proportion of about 50 to 75% by weight, said toner and carrier adhering respectively to the first and second image portions; and a third step of transferring the developed image onto a transfer paper.

3. An image forming method as claimed in claim 2 wherein said nonmagnetic insulating toner is adhered between the bias voltage and the first level of potential and said high-resistivity magnetic carrier is adhered between a threshold voltage and the second level of potential, said threshold voltage being primarily dependent on magnetic field and electric field and the voltage thereof is between the bias voltage and the second level of potential.

4. An image forming method as claimed in claim 3 wherein said three different levels of potentials are all of the same polarity.

5. An image forming method as claimed in claim 3 wherein said first and second levels of potentials are opposite in polarity.

6. An image forming method comprising:

a first step of uniformly charging a photosensitive member to a surface potential of V1;

a second step of exposing a first image of positive image thereby forming a first electrostatic latent image with the potential of exposed portions decaying to an intermediate potential of V3 and the nonexposed portions substantially unchanged;

a third step of exposing a second image of negative image to the intermediate potential portion thereby forming a second electrostatic latent image with the potential of exposed portions decaying to V2 so that a composite electrostatic latent image having potentials of V1, V3 and V2 in the order of decreasing potential is formed;

a fourth step of developing said composite electrostatic latent image with a developer by a magnetic brush development while applying to a developing electrode a bias voltage Vb substantially equal to or close to said intermediate potential of V3, said developer being composed of at least two components of a nonmagnetic insulating toner and a high-resistivity magnetic carrier triboelectrically chargeable with the toner and having a high resistivity of at least $10^{12}$ ohm-cm, the carrier being in the form of particles about 5 to 40 microns in size composed of a magnetic fine powder dispersed in an insulating resin and containing the magnetic fine powder in a proportion of about 50 to 75% by weight, said toner adhering to the first electrostatic latent image portion between the bias voltage Vb and the surface potential V1 and said carrier adhering to the second electrostatic latent image portion between a threshold voltage and V2, said threshold voltage being lower than the bias voltage Vb and dependent on magnetic field and electric field; and a fifth step of transferring the developed image to a transfer paper.

7. An image forming method as claimed in claim 6 wherein said threshold voltage is at least 200 V lower than the bias voltage Vb.

8. An image forming method as claimed in claim 7 wherein said toner and carrier are different in color.

9. An image forming method comprising;

a first step of forming an electrostatic latent image corresponding to a two-color original and having a first color image portion potential and a second color image portion potential opposite in polarity respectively;

a second step of developing said electrostatic latent image with a developer by a magnetic brush development while applying to a developing electrode a bias voltage equal to or close to a nonimage portion potential of the latent image, said developer being composed of a nonmagnetic insulating toner of a first color triboelectrically chargeable to the first polarity and a high-resistivity magnetic carrier of a second color triboelectrically chargeable to the second polarity and having a high resistivity of at least $10^{12}$ ohm-cm, the carrier being in the form of particles about 5 to 40 microns in size composed of a magnetic fine powder dispersed in an insulating resin and containing the magnetic fine powder in a proportion of about 50 to 75% by weight, said toner and carrier adhering respectively to the first and second color image portions; and a third step of transferring the developed image to a transfer paper.

* * * * *